US006966313B1

(12) United States Patent
Yokota et al.

(10) Patent No.: US 6,966,313 B1
(45) Date of Patent: Nov. 22, 2005

(54) ANTI-CHOP ELECTRONIC FIRING CONTROL FOR PAINTBALL MARKERS

(75) Inventors: Michael J. Yokota, San Diego, CA (US); Lester Broersma, San Diego, CA (US)

(73) Assignee: JT USA LLC, Corona, CA (US)

( * ) Notice: Subject to any disclaimer, the term of this patent is extended or adjusted under 35 U.S.C. 154(b) by 0 days.

(21) Appl. No.: 10/873,984

(22) Filed: Jun. 21, 2004

(51) Int. Cl.[7] ..... F41B 11/00; F41B 11/02
(52) U.S. Cl. ..... 124/32; 124/74; 124/77
(58) Field of Search ..... 124/31, 32, 73, 124/74, 77

(56) References Cited

U.S. PATENT DOCUMENTS 5,727,538 A * 3/1998 Ellis ..... 124/77
6,142,137 A * 11/2000 MacLaughlin ..... 124/72
6,523,534 B2 * 2/2003 Juan ..... 124/32
6,748,938 B2 * 6/2004 Rice et al. ..... 124/77

* cited by examiner

*Primary Examiner*—John A. Ricci
(74) *Attorney, Agent, or Firm*—Charmasson, Buchaca & Leach, LLP

(57) ABSTRACT

In a paintball gun in which projectiles are admitted into the breech from a feed port through a radial aperture, sensors positioned in line with the aperture detect whether a projectile is completely or partially inserted into the breech, or totally missing. An electronic logic circuit allows the firing of the gun only when the projectile is fully inserted, and prevents the firing when the projectile is only partially inserted into the breech. A dry firing of the gun is enabled if the breech remains empty of any projectile for a short period. The dry firing is intended to dislodge any projectile jammed in the feed port.

12 Claims, 3 Drawing Sheets

ANTI-CHOP ELECTRONIC FIRING CONTROL FOR PAINTBALL MARKERS

FIELD OF THE INVENTION

This invention relates to pneumatic guns, and more particularly to paintball markers.

BACKGROUND OF THE INVENTION

Contemporary paintball guns or markers are equipped with solenoid-driven firing mechanisms that allow rapid firing of a number of projectiles with a single pull of the trigger. Paintballs have a soft-frangible envelope which can deform and even break under pressure. A deformation of the spherical shape of paintballs can lead to jamming in the feed port of the gun or only partial insertion into the breech. The firing of the gun with a paintball only partially inserted results in the chopping of the ball and fouling of the breech and barrel.

Mechanical as well as electronic anti-chop systems have been proposed in the prior art which simply allows firing of the gun only when a projectile is fully and properly inserted into the breech. Although such a system is effective in preventing the chopping of the paintball, it does not provide the user of the gun with an indication of whether a paintball is only partially inserted in the breech or if the paintball is jammed higher up in the feed port or in the paintball magazine. A jamming of the projectile ahead of the breech can often be corrected by dry-firing the gun in order to shake loose the jammed paintball. However, firing the gun on a partially inserted projectile can lead to a disabling of the weapon.

SUMMARY OF THE INVENTION

The principal and secondary objects of this invention are to provide an intelligent control of the firing mechanism which can recognize whether a projectile is either fully inserted into the breech of a gun or only partially inserted, or is not present at all in the breech. Instant firing is allowed upon detection of a projectile fully inserted into the breech. If the projectile has not began to enter the breech due to some upstream jamming, the control system allows a delayed dry-firing designed to unjam the projectile. If the system detects a projectile only partially inserted into the breech, firing is disabled and an indication is provided to the user that corrective action is required.

These and other valuable objects are achieved by installing one or more sensors around the area of the breech where the projectile is being admitted and interpreting the indication of the sensor or sensors by means of an electronic logic circuit that disables or enables the operation of the firing solenoid.

DESCRIPTION OF THE PREFERRED EMBODIMENT OF THE INVENTION

Figure 1:
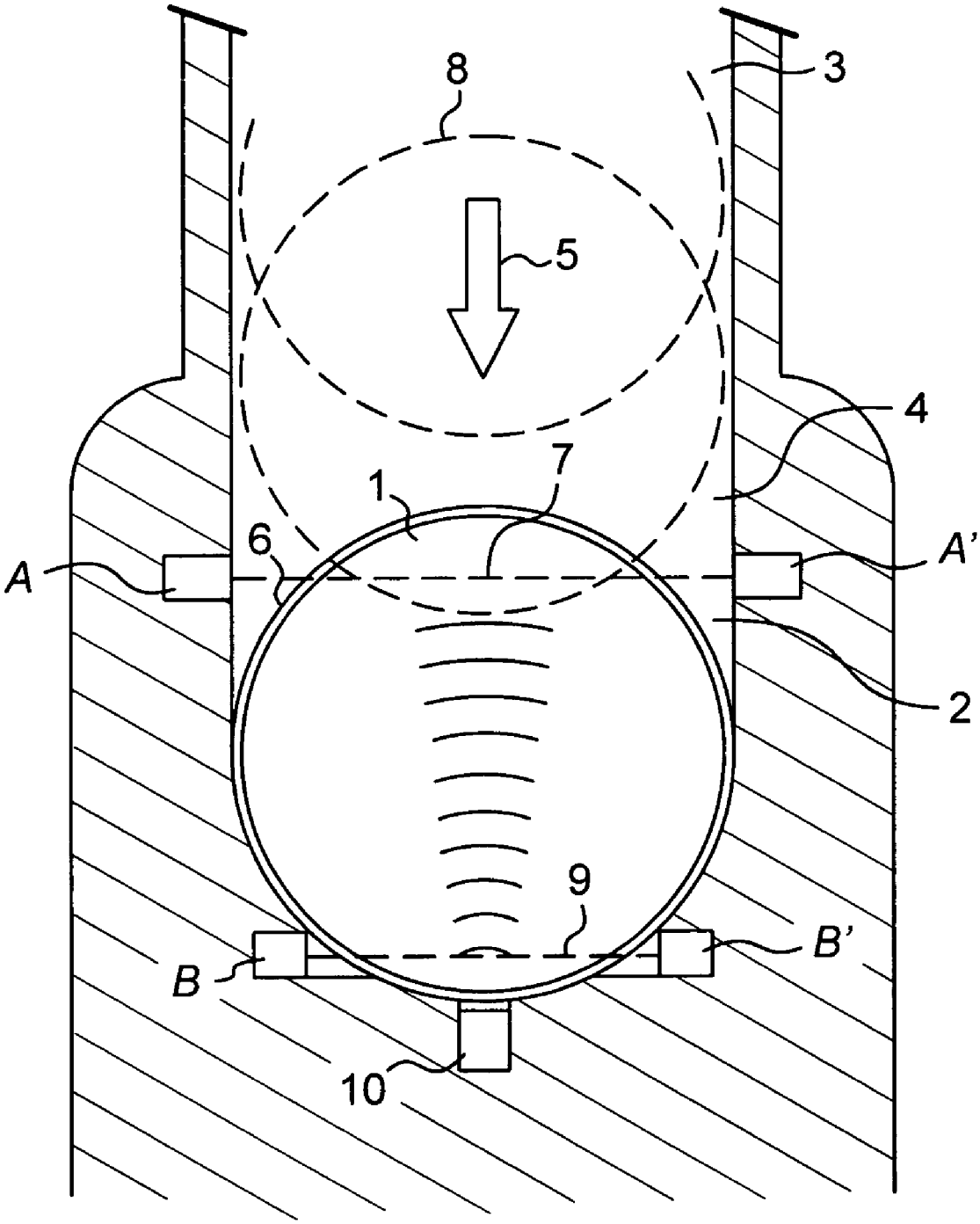
FIG. 1 is a partial, transversal cross-sectional view of the breech section of a paintball marker according to the invention.

Referring now to the drawing, an anti-chop firing mechanism is disclosed in connection with a pneumatic gun in which a projectile such as a paintball is radially admitted into the breech of the gun from a radial feed port through an aperture commonly located in the upper section of the breech. Such a paintball gun is disclosed in U.S. Pat. No. 6,474,326 which is incorporated in its entirety into this specification by this reference.

In a pneumatic paintball marker or gun in which projectiles 1 are admitted into the breech 2 from a feeding port 3 through an aperture 4 in a radial direction 5 in reference to the axis, the breech and barrel 6, the firing of the marker is conditioned upon the output of one or more sensors positioned in the breech to detect the presence and correct positioning of the projectile.

More specifically, a first photo-interrupter sensor A–A' is positioned across the breech proximate the aperture 4. The sensor comprises an emitter A in one wall of the breech which is aimed at a receiver A' located in the opposite wall of the breech so as to place a light beam 7 about 0.003 inches (76 microns) below the aperture and intercept orthogonally the axis of travel of the paintball being fed into the breech. When the beam 7 is interrupted by a ball 1 fully inserted into the breech or by a ball 8 which is only partially inserted, the sensor A–A' generates a true or positive signal. A second sensor B–B' of the same type as the first is positioned opposite the aperture 4 at approximately 0.003 inches (76 microns) from the lowermost point of the breech so that its beam 9 is parallel to the beam 7 of the first sensor, and across the same axis of travel of the projectiles. This second sensor will only give or positive signal when the ball 1 is fully inserted into the breech.

It should be understood that other types of sensors could be substituted for the photo-interrupter type just described. For instance, effective sensors which use only one element acting as both the emitter and receiver could be used. Other types of proximity sensors such as a Hal-effect sensor or mechanical contact sensors would provide equivalent substitutes. Alternately, a single doppler-type sensor 10 could be installed immediately below the lowermost part of the breech in actual alignment with the direction of travel 5 of the projectiles. This type of sensor can provide two or more indications of its distance from the projectile. For the sake simplicity, this doppler-type sensor will be presumed to issue two discrete signals, one indicating that the ball is only partially inserted, another to indicate the ball is fully set into the breech, as provided by the pair of A–A' and B–B' sensors.

Figure 2:
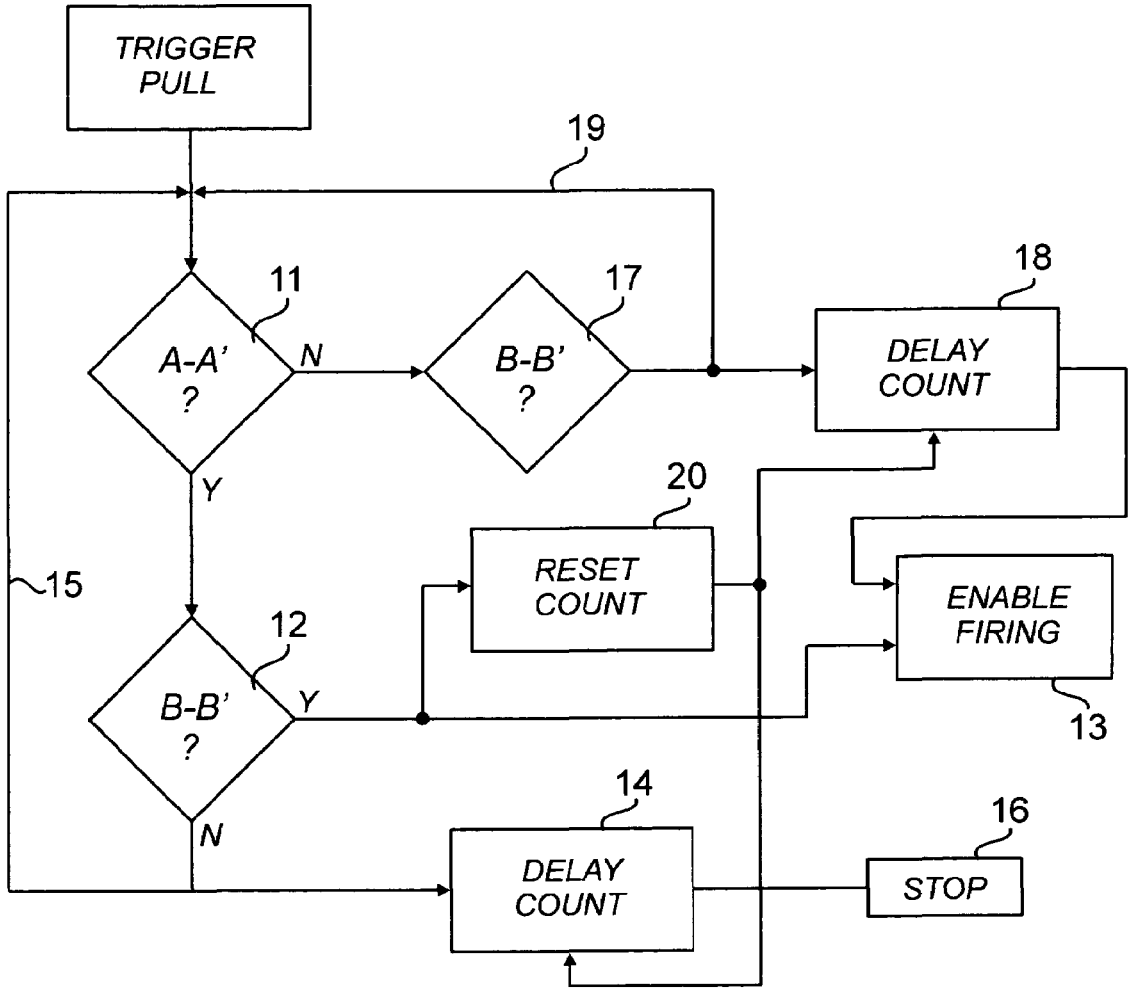
FIG. 2 is a flow chart of the anti-chop firing control process.

Upon the pull of the trigger, the outputs of the sensors are analyzed by an electronic logic circuit according to the flow diagram of FIG. 2. The logic circuit first looks 11 for the presence of a true indication from the first sensor A–A'. If the presence of a projectile is detected, the logic circuit looks 12 a the output of the second sensor B–B'. If the indication is true, the projectile is presumed to be in good position for firing 5. An enabling signal is provided 13 to the firing mechanism. If the output of the second sensor is false, the logic circuit concludes that the presence of a true signal from the first sensor in the absence of one from the second indicates that the projectile is jammed in a partially inserted position. A delay count of approximately 0.5 second is initiated 14 while the circuit continues to interrogate 15 the two sensors about every 20 milliseconds. If the end of the delay count is reached without any change in the position of the projectile, a fire-disabling or stop firing warning indication 16 is provided to the user of the gun by way of an alarm or visual signal. The user can then attempt to free the jammed projectile.

If the first sensor A–A' gives a false reading, the logic circuit looks 17 at the output of the second sensor B–B' in order to verify there is no debris in the breech. Upon detection of a false reading out of the second sensor, the logic circuit starts a delay count 18 of about 0.5 seconds while, at the same time, continuing to interrogate 19 the sensors. If the end of the count is reached without any true signal being issued from either sensor, a fire-enabling signal is issued 13. It is expected that a dry-firing of the gun will dislodge any projectile that may be jammed in the feed port or in the projectile magazine. A dry-firing could also indicate that the magazine is empty.

Every time both sensors indicate the presence of a ball, a reset operation 20 is initiated that stops the delay counts 14, 18 and resets them to 0.

Figure 3:
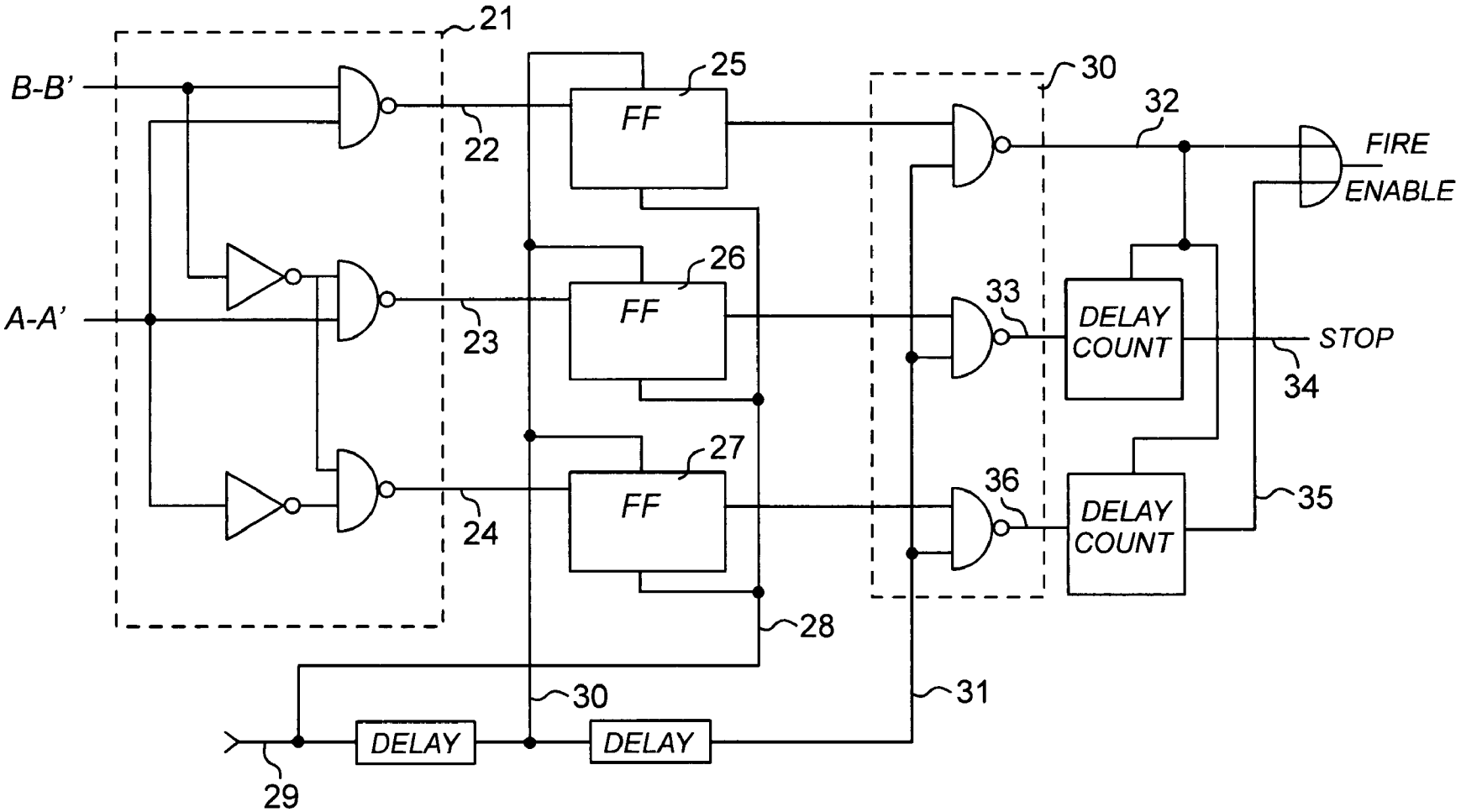
FIG. 3 is a diagram of the electronic logic circuit.

An hard-wired type of logic circuit 21 is illustrated in FIG. 3. A gate circuit is first used to provide indications of the three pertinent statuses of the sensors. The first indication 22 is that both sensors are true. The second indication 23 is that the first sensor is true but the second is false. The third indication 24 is that both sensors are in the false state. The statuses of the sensors are stored in three flip-flop latches 25, 26, 27. The latches are reset by a first phase 28 of the clock signal 29. A few milliseconds thereafter, a latches set signal 30 is issued. After a few more milliseconds, the status of the latches is read to a set of gates 30 enabled by a check signal 31. The firing is enabled by a first signal 32 that both sensors are in the true state. This signal also is used to reset the delay counters 14, 18 described in connection with the flow chart. Signal 33 indicating a partially inserted projectile triggers the first delay counter 14 which, if allowed to reach its full count, will issue a stop signal 34. The third signal 36 indicating that there is no projectile either fully or partially inserted into the breech, triggers the second delay counter 18 which, if allowed to reach its full count, triggers a fire-enabling signal 35.

The hard-wired third circuit just described could be advantageously replaced by a computer program run through a micro-processor according to techniques well-known to those skilled in the electronic arts.

The instant firing control system not only avoids firing the gun when a projectile is only partially inserted into the breech, thus avoiding breaking of the projectile by the bolt-mechanism, but the system also automatically initiates dry-firing to dislodge a projectile that may have been jammed ahead of the breech.

It should be understood that additional sensors could be advantageously placed in the feeding port in order to provide an indication of the presence or the progress of a projectile down the port.

While the preferred embodiments of the invention have been described, modifications can be made and other embodiments may be devised without departing from the spirit of the invention and the scope of the appended claims.

What is claimed is:

1. In a pneumatic gun in which a projectile is radially admitted into a breech through an aperture, a firing mechanism which comprises:

a first sensor positioned to issue a first signal indicating the presence of an object in a section of said breech opposite said aperture;

a second sensor positioned to issue a second signal indicating the presence of an object in a section of said breech proximate said aperture;

means for interpreting said first and second signals; and means responsive to said means for interpreting, for controlling the firing of said marker.

2. The mechanism of claim 1, wherein said means for interpreting comprise means for detecting the presence of said first signal.

3. The mechanism of claim 2 which further comprises means, responsive to said means for detecting, for generating a fire-enabling command.

4. The mechanism of claim 3, wherein said means for interpreting further comprises:

means for recognizing the presence of said second signal in the absence of said first signal; and means, responsive to said means for recognizing, for generating a fire-disabling command.

5. The mechanism of claim 1, wherein said means for interpreting comprise means for recognizing the presence of said second signal in the absence of said first signal.

6. The mechanism of claim 5 which further comprises means, responsive to said means for recognizing, for generating a fire-disabling command.

7. The mechanism of claim 6 which further comprises means for issuing a delayed warning after a first period of time.

8. The mechanism of claim 1, wherein said means for interpreting comprises means for perceiving the absence of said second signal.

9. The mechanism of claim 8 which further comprises means, responsive to said means perceiving, for delaying the firing of said gun for a second period of time.

10. In a pneumatic gun in which a projectile is radially admitted into a breech through an aperture, a firing mechanism which comprises:

a proximity sensor positioned to detect whether a projectile is either completely inserted into said breech, partially inserted into said breech, or not present within said breech;

an electronic logic circuit responsive to said sensor and programmed to allow firing of said gun when a projectile is completely inserted into said breech, and to prevent firing of said gun when a projectile is only partially inserted into said breech.

11. The mechanism of claim 10 which further comprises an electronic logic circuit responsive to said sensor and programmed to allow a dry firing of said gun when no projectile is present in said breech.

12. A method for controlling the firing of a gun having a breech into which a projectile is radially fed through an aperture, said method comprising;

detecting by means of a first sensor associated with said breech, whether a projectile is partially inserted therein;

detecting by means of a second sensor associated with said breech, whether a projectile is fully inserted therein;

enabling a firing if a projectile is fully inserted in said breech;

enabling a delayed firing if no projectile is either partially or fully inserted in said breech; and disabling firing if a projectile is only partially inserted in said breech.

* * * * *